US005905510A

United States Patent [19]

Hagiwara et al.

[11] Patent Number: 5,905,510

[45] **Date of Patent: *May 18, 1999**

[54] TONER CONTENT MONITORING SYSTEM FOR USE IN A RECORDING HEAD FOR INK-JET PRINTER

[75] Inventors: Yoshihiro Hagiwara; Hitoshi Minemoto; Ryosuke Uematsu; Junichi Suetsugu; Kazuo Shima, all of Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/718,245

[22] Filed: Sep. 20, 1996

[30] Foreign Application Priority Data

Sep. 21, 1995 [JP] Japan ..... 7-242690

[51] Int. Cl.[6] ..... B41J 2/195

[52] U.S. Cl. ..... 347/7; 101/DIG. 45; 399/64

[58] Field of Search ..... 347/7; 101/DIG. 45; 399/64

[56] References Cited

U.S. PATENT DOCUMENTS

| | | | |
|---|---|---|---|
| 3,494,328 | 2/1970 | Maloney | 399/64 |
| 3,682,132 | 8/1972 | Kamola | 399/64 |
| 3,727,065 | 4/1973 | Maksymiak | 399/64 |
| 4,681,454 | 7/1987 | Breemer | 356/402 |
| 5,136,309 | 8/1992 | Iida et al. | 347/7 |
| 5,241,189 | 8/1993 | Vandagriff et al. | 347/7 |
| 5,276,481 | 1/1994 | Kinoshita et al. | 399/64 |
| 5,373,366 | 12/1994 | Bowers | 347/7 |
| 5,530,529 | 6/1996 | Henderson et al. | 399/64 |
| 5,694,156 | 12/1997 | Hoisington et al. | 347/7 |
| 5,788,388 | 1/1997 | Cowger | 347/7 |
| 5,841,448 | 11/1998 | Moriyama et al. | 347/7 |

FOREIGN PATENT DOCUMENTS

| | | | |
|---|---|---|---|
| 0571784 | 12/1993 | European Pat. Off. . | |
| 0597628 | 5/1994 | European Pat. Off. . | |
| 0661162 | 7/1995 | European Pat. Off. . | |
| 55-84674 | 6/1980 | Japan | 347/7 |
| 62-156963 | 7/1987 | Japan | 347/7 |
| A 8-90825 | 4/1996 | Japan . | |
| A 9-1824 | 7/1997 | Japan . | |

OTHER PUBLICATIONS

Patent Abstracts of Japan, Abstract of JP–A 58–151258.
Patent Abstracts of Japan, Abstract of JP–A 02–107452.
Patent Abstracts of Japan, Abstract of JP–A 04–175169.

*Primary Examiner*—Edgar Burr
*Assistant Examiner*—Daniel J. Colilla
*Attorney, Agent, or Firm*—Sughrue, Mion, Zinn, Macpeak & Seas, PLLC

[57] ABSTRACT

A system for monitoring the toner content in ink. The system comprising a light source and a photo-detector disposed in a ink chamber wall, a controller and a display unit. A content-monitoring voltage V1 and an operation-checking voltage V2 are determined from experiments in advance. V1 and V2 are such light source voltages when a predetermined current Ith is obtained from the photo-detector for the minimum and maximum allowable toner contents, respectively. In usual operation in user site, operation of the system is checked with the light source voltage set for V2 in response to a power-on or a reset. Then, a monitoring of the toner content is started with the light source voltage set for V1. In a toner content monitoring, the sensor current is checked to see if it is equal to or larger than Ith.

11 Claims, 8 Drawing Sheets

TONER CONTENT MONITORING SYSTEM FOR USE IN A RECORDING HEAD FOR INK-JET PRINTER

BACKGROUND OF THE INVENTION

The present invention relates generally to a method and a system for measuring the content of particles dispersed in a solvent and, more specifically, to a method and a system for monitoring the toner content in ink contained in a recording head for a printer.

There are electrostatic ink-jet printers in which high-speed high-quality printing is achieved by discharging a jet of charged toner contained in liquid ink by means of electric field.

In such an ink-jet printer, just after discharging a jet of charged toner, a jet of toner has to be quickly prepared for the next discharge for a higher speed, and the toner content in a jet of toner (to be more precise, a jet of toner is a mixture of charged toner and ink) has to be more than a certain level for a higher printing quality without any blot or blur. Thus, in order for this kind of ink-jet printer to exhibit its advantages such as a high speed and a high printing quality, the toner content in ink has to be kept at a sufficient level.

There have been proposed techniques for detecting the presence of electrified toner by means of actinometry or resistance measurement and for warning the user to supply toner. However, since the measurements are performed only in a binary fashion, such toner detecting techniques can not be used for maintaining a predetermined charged toner content in ink.

Japanese unexamined patent publication No. Hei2-102061 (1990) discloses a system for detecting the ink residual quantity. In this system, the level of the surface of ink is detected by knowing whether the optical path of the detecting system is above the surface level or not. For this reason, this system can not measure the charged toner content in ink.

SUMMARY OF THE INVENTION

It is therefore an object of the invention to provide a method and a system for monitoring the charged toner content in ink to ensure a sufficient residual quantity of charged toner thereby to achieve a high speed and a high-quality of printing which matches those of an electrophotographic printer.

In one aspect of the invention, a toner content monitoring system comprises a light source and a light detector disposed in facing walls of an ink chamber of a recording head in such a manner that the light detector can effectively detect the light from the light source through the ink between the light source and the light detector. The system further comprises a controller to which the light source and the light detector are connected, and a display unit for displaying the results of monitoring.

First, from experiments the toner content which is the allowable minimum for the heads of a relevant kind is decided, and the decided charged toner content is a "supply-requiring content C1" set by the manufacturer. Then, the charged toner content for the supply-requiring content is set by monitoring the detected electric current from the light detector, while gradually increasing the voltage applied to the light source or the light source voltage, until the detected current reaches a predetermined level. The light source voltage when the detected current equals the predetermined level is selected as a "content monitoring voltage V1" for the light source.

Further the light source voltage when the detected current for the maximum possible toner content C2 equals the predetermined level is selected as an "operation checking voltage V2".

In an ordinary process of using a printer incorporating the inventive toner content monitoring system, operation of the toner content monitoring system is checked with the light source voltage set for the operating checking voltage V2 in response to a power-on or a reset by the user. In an operation checking, the detected current is checked to see if it is equal to or larger than the predetermined level. If so, the toner content monitoring system is regarded as normal. Otherwise, the toner content monitoring system is regarded as abnormal.

Then, a monitoring of the toner content is started with the light source set for the content monitoring voltage V1. In a toner content monitoring, the detected current is checked to see if it is equal to or larger than the predetermined level. If so, the toner content is regarded as insufficient or in need of toner supply. Otherwise, the toner content is regarded as sufficient.

BRIEF DESCRIPTION OF THE DRAWINGS

The objects and features of the present invention will become more apparent from the consideration of the following detailed description taken in conjunction with the accompanying drawings, in which.

DESCRIPTION OF THE PREFERRED EMBODIMENTS

Embodiment I

Figure 1:
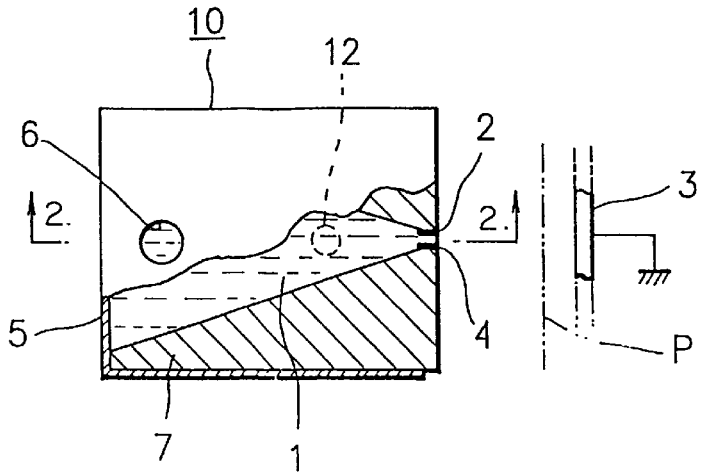
FIG. 1 is a partial cross section, viewed from the top, of a recording head which uses a toner content monitoring system according to a first illustrative embodiment of the invention.

FIG. 1 is a partial cross section, viewed from the top, of a recording head 10 to which the present invention is applied. In the purpose of better understanding, an exemplary recording head used for an electrostatic ink-jet printer which uses ink including charged toner will be first described. In FIG. 1, the recording head 10 comprises: a dielectric wall 7 forming an ink chamber 1 for containing transparent liquid ink including opaque charged toner; an ink discharge hole 2 provided in the front wall and connecting the ink chamber with the outside; an electrode 3 grounded and disposed face to face with the front wall with a space for paper forwarding path; a discharge electrode 4 disposed at the ink discharge hole 2 for generating, in a space extending to the electrode 3, an electric field for promoting a discharge of charged toner; an electrophoretic electrode 5 so disposed as to enclose the ink chamber 1 for generating an electric field for promoting the electrophoresis of the toner to the ink discharge hole 2 in cooperation with the discharge electrode 4; and an ink feeding hole 6 formed in the top wall of the ink chamber 1 which is connected through a tube to an ink storage chamber (not shown). It is noted that the ink in the ink storage chamber and the ink chamber 1 is circulated by means of a pump.

Specifically, the discharge electrode 4 is set for a high potential of the same polarity as that of the charged toner at the time of toner discharge, and for the same potential as that of the electrode 3 at the other time. The discharge electrode 4 has its toner discharging end sharpened like a pin so that the electric field concentrates on the end to thereby facilitate the discharging of toner. The discharge electrode 4 is embedded in the dielectric wall 7 in the direction perpendicular to the ink discharging direction.

The electrophoretic electrode 5 is always supplied with a high voltage of the same polarity as that of the charged toner. This voltage is set higher than that of the discharge electrode 4.

Figure 2:
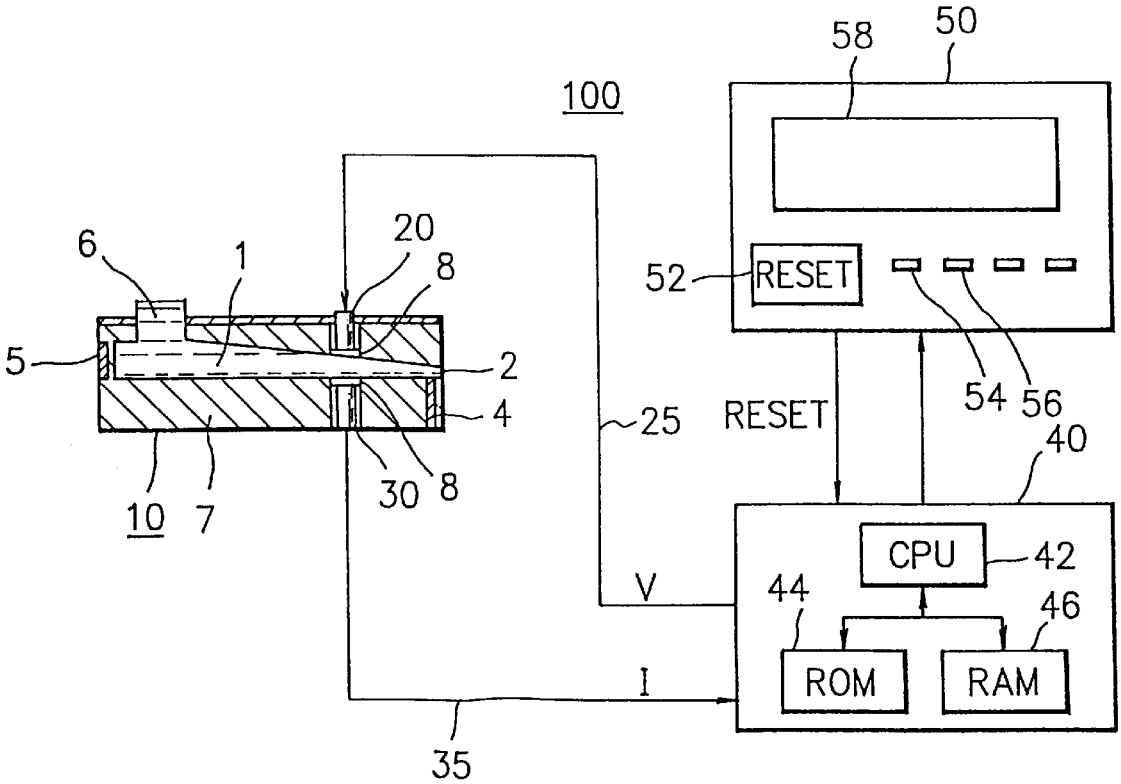
FIG. 2 is a diagram showing an arrangement of the toner content monitoring system, including a cross section taken along line 2 in FIG. 1.

FIG. 2 shows an arrangement of the toner content monitoring system, including a cross section taken along line 2 in FIG. 2. In FIG. 1, the toner content monitoring system 100 comprises a light source 20 for emitting light as detailed later, and a photo-detector 30 for receiving the light from the light source 20 and providing an output responsive the intensity of the received light. The light source 20 comprises, for example, a light emitting diode. The photo-detector 30 comprises, for example, a photo-diode. A light emitting portion of the light source 20 and a light receiving portion of the photo-detector 30 are inserted through holes in facing sides of the dielectric wall 7, and have cover members 8 on the tops thereof. The cover members 8 prevents the ink from leaking to the outside. The ink comprises petroleum organic solvent, electrification regulator agent, and toner or colored. corpuscle of thermoplastic resin which is dispersed in the petroleum organic solvent. The toner has been electrified by so-called zeta potential and is inherently positive.

The toner content monitoring system 100 further comprises a controller 40 to which the light source 20 and the photo-detector 30 are connected, by connections 25 and 35, respectively, and a console 50.

As is well known in the art, the controller 40 comprises a central processing unit (CPU) 42 for controlling operation of the toner content monitoring system 100 under the control of a program, a read only memory (ROM) 44 for storing the above and other programs and data for controlling the printer (not shown) incorporating the toner content monitoring system 100, and a random access memory 46 for storing various data, and input and output interfaces (not shown) for the light emitting diode 20, the photo-diode 30 and the console 50.

The console 50 comprises at least interfaces for a reset button 52, an operation condition indicator (e.g., light emitting diode) 54 for indicating the operation condition of the toner content monitoring system 100 as detailed later, and a toner indicator (e.g., light emitting diode) 56 for warning the user to supply toner as described in detail later. The console 58 may further comprise a display 50.

Printing operation is as follows. When the printer (not shown) using the system 100 is turned on, a voltage is applied to the electrophoretic electrode 5 to form an electric field between the electrode 4 and the discharge electrode 4. This causes the charged toner in the ink to electrophoretically move concentrating near the ink discharge hole 2 forming an ink meniscus in the ink discharge hole 2.

If another voltage is applied to the discharge electrode 4 in order to discharge a jet of charged toner, then new electric field is formed between the electrode 4 and the electrode 3 facing the electrode 4. This causes charged toner adjacent to the ink discharge hole 2 to concentrate on the head of the meniscus which is nearer to the electrode 3. If the electrostatic force applied to the gathering charged toner overcomes the surface tension of the meniscus, then the gathering charged toner is discharged in a jet toward the electrode 3, and adheres to the recording paper disposed in front of the electrode 3. Then, the recording paper is forwarded to a fixing section (not shown) and fixed as in an electrophotographic printer.

Upon the discharge of toner, charged toner of the quantity in which the toner near the ink discharge hole 2 has been decreased is quickly supplied back to the ink discharge hole 2.

Thus, in an electrostatic ink-jet printer according to the present invention, recording is achieved by substantially discharging charged toner only. Accordingly, the toner content in the ink decreases in the course of recording operation. If the toner content has decreased to a certain extent, normal printing operation may become impossible because of the insufficiency of charged toner near the ink discharge hole 2 even if some toner remains in the ink. How a sufficient content of charged toner is ensured will be described in the following.

In operation, the toner content monitoring system 100 uses two constants, which have to be decided in advance during manufacture of the system.

Figure 3:
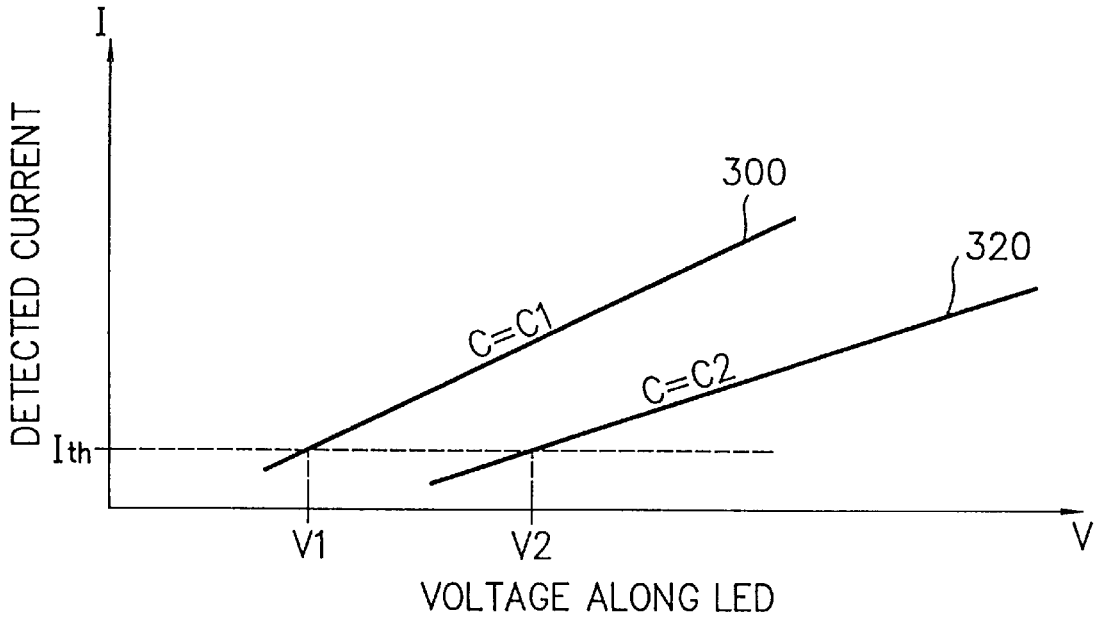
FIG. 3 is a diagram showing relations between the light source voltage and the detected current of photo-detector when the toner content is the minimum allowable and the maximum allowable.
Figure 5:
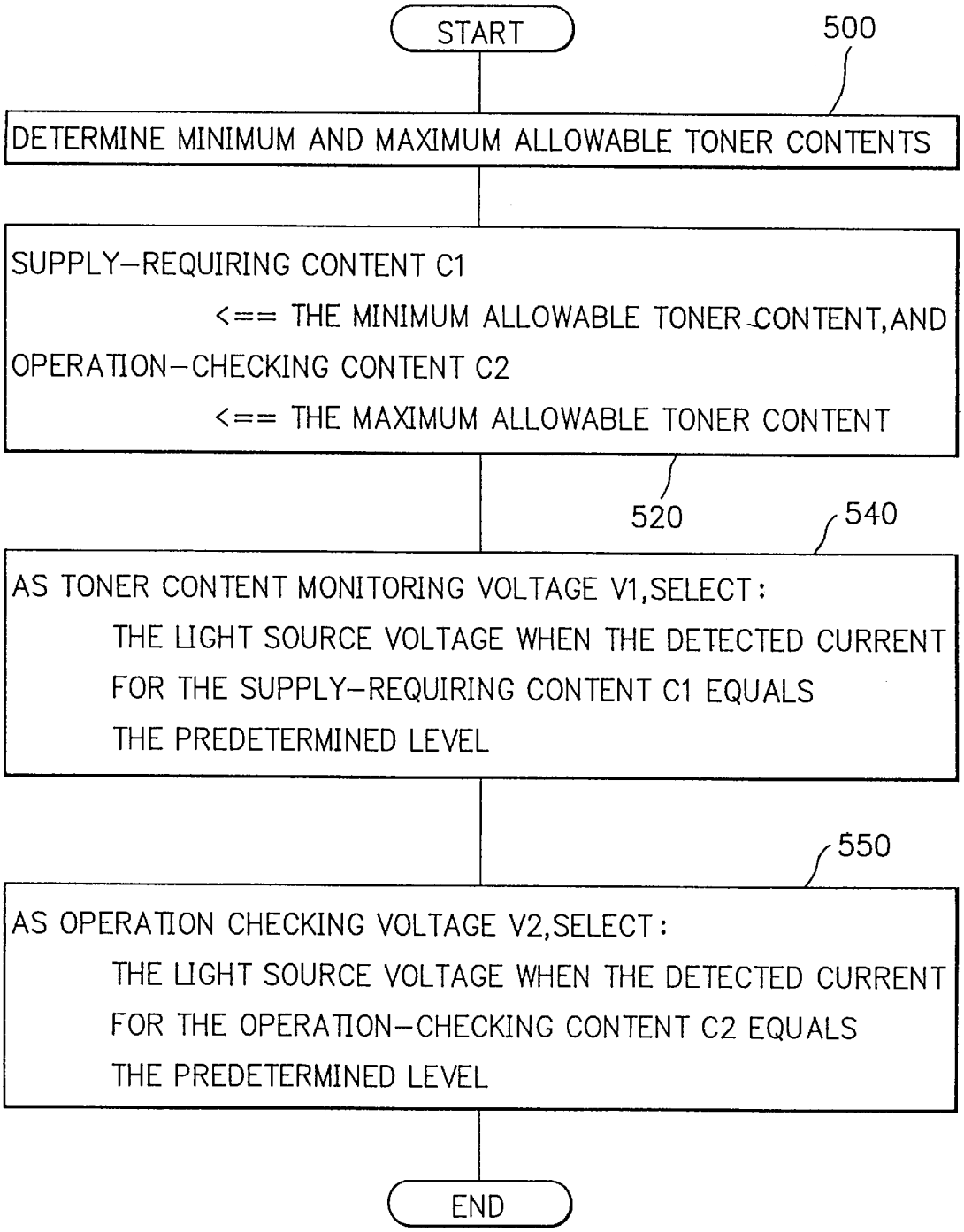
FIG. 5 is a flow chart showing an exemplary flow of procedures for obtaining the constants which are executed in the manufacture of the toner content monitoring system.

Referring to FIGS. 3 and 5, how the constants are decided will be described in the following. As seen from the arrangement of the toner content monitoring system 100, the electric current running through the photo-diode 30 (or detected current) I varies substantially linearly 300, 320 with the voltage applied to the light emitting diode (LED) 20 or the light source voltage V, and decreases with the increase of the toner content. FIG. 3 shows relations between the light source voltage V and the detected current I when the toner content is the minimum allowable 300 and the maximum allowable 320.

FIG. 5 is a flow chart showing a flow of procedures for obtaining the constants which are executed during manufacture of the toner content monitoring system. In FIG. 5, the range of optimum toner content is first decided from experiments in step 500. The lower and the upper limits of the range are stored in the locations for a supply-requesting content C1 and a operation-checking content C2 in ROM 44 in step 520. Then, for each of the minimum and maximum allowable contents, the V-I characteristic curve is plotted again from experiments, which yields a graph as shown in FIG. 3. The detected current I is compared with a predetermined threshold Ith in an interface (not shown) in the controller 40. It is assumed that the light from the LED 20 is detected by the photo-detector 30 if the current I is equal to or more than the threshold. For the minimum allowable content or supply-requesting content C1, such a light source voltage that the detected current I equals the threshold current Ith is stored in a location for a toner content monitoring voltage V1 in ROM 44 in step 540. For the maximum allowable content or operation-checking content C2, such a light source voltage that the detected current I equals the threshold current Ith is stored in a location for an operation checking voltage V2 in ROM 44 in step 550. The operation checking voltage V2 is used for a reference voltage for checking whether the system 100 is operating normally, as detailed later.

Figure 4:
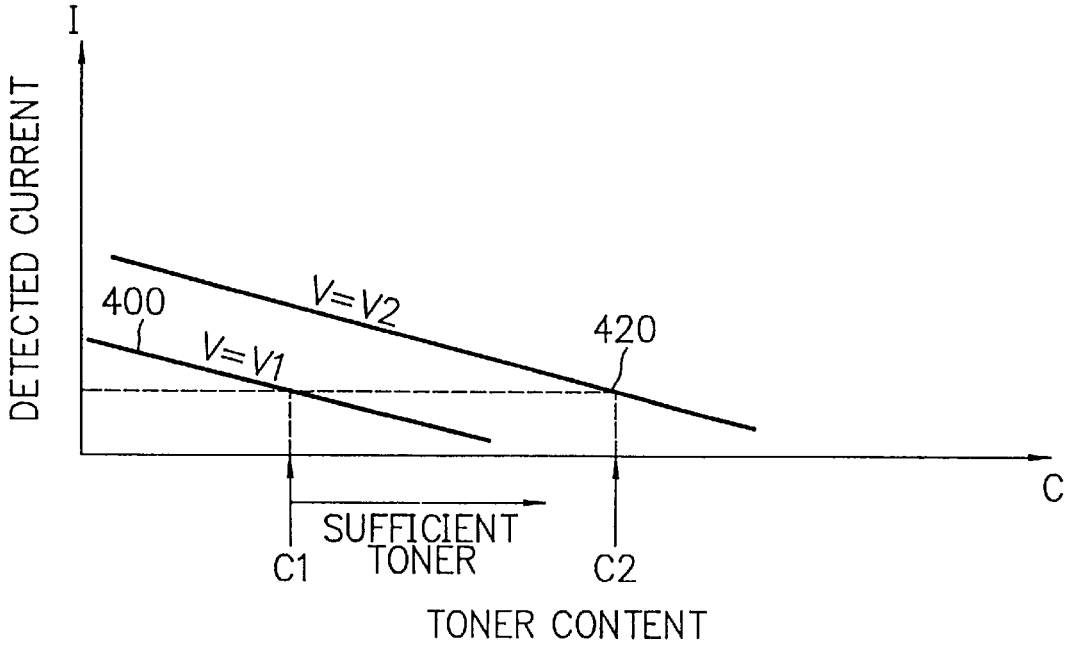
FIG. 4 is a diagram showing relations between the toner content and the detected current of photo-detector when the light source voltage is the content monitoring voltage and the operation check voltage.
Figure 6:
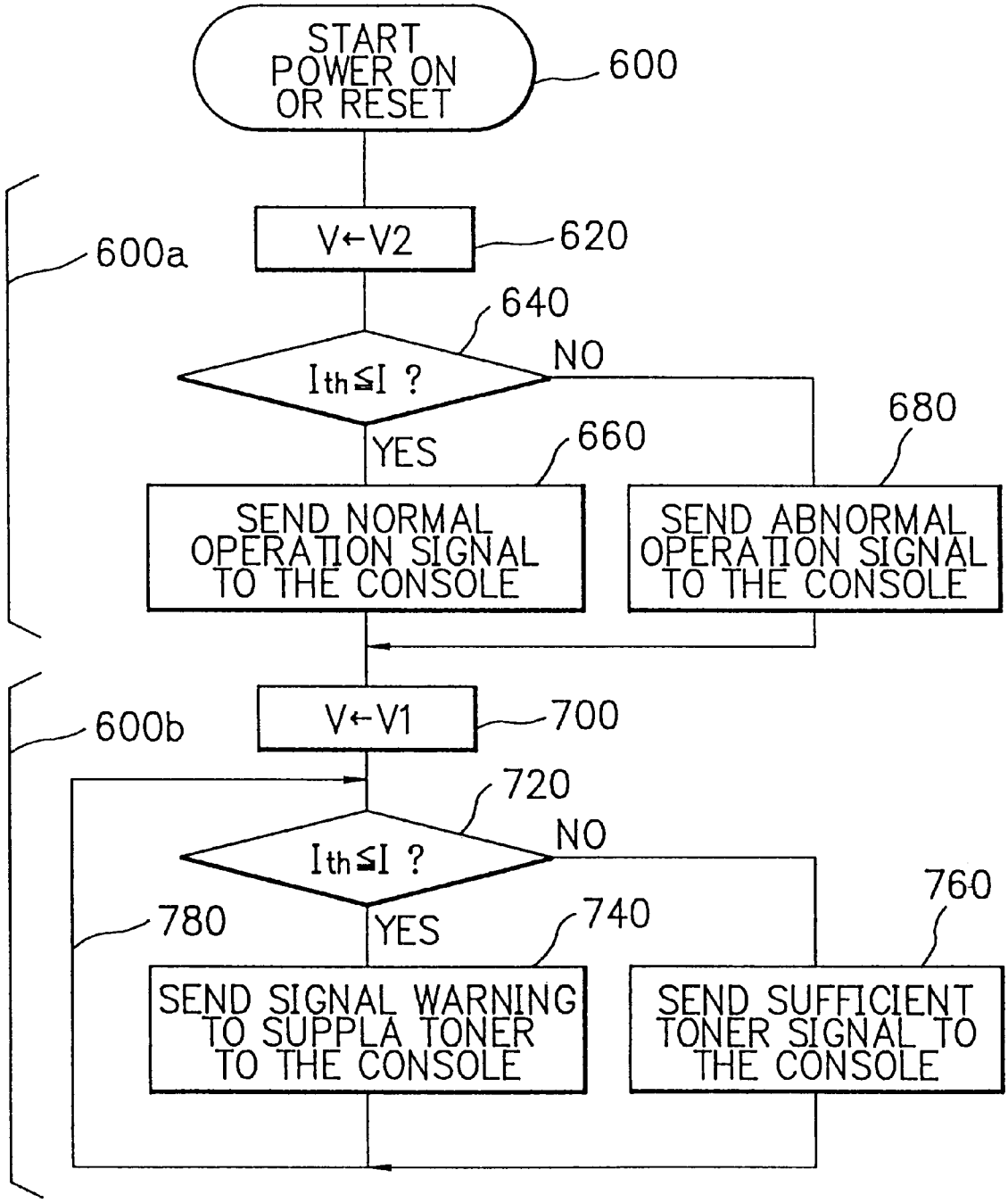
FIG. 6 is a flow chart showing an exemplary program for monitoring the toner content which is stored in ROM 44 and executed by CPU 42 according to the invention.

Referring now to FIGS. 4 and 6, operation by the system 100 for monitoring the toner content will be described in the following. FIG. 4 shows detected current characteristic curves 400 and 420 with respect to the detected current I for V=V1 and V2, respectively.

As seen from the characteristic curve 400 for V=V1, the toner content C is regarded as insufficient if the detected current I is equal to or larger than Ith, and regarded as sufficient, otherwise. Similarly, as seen from the characteristic curve 420 for V=V2, the detected current I must be always larger than Ith if the toner monitoring system 100 is normal in operation. Therefore, the content monitoring voltage V1 is used for monitoring the toner content in ink, and the operation checking voltage V2 is used for checking operation of the system 100.

FIG. 6 is a flow chart showing an exemplary program for monitoring the toner content which is stored in ROM 44 and executed by CPU 42 according to the invention. In FIG. 6, the program is invoked in block 600 when the system 100 is turned on or reset. Then, system checking procedures are first executed as shown in step 600*a* or steps 620 through 680, and thereafter toner content monitoring procedures are repeated as shown in step 600*b* or steps 700 through 760.

In the system checking stage 600*a*, the CPU 42 first sets the light source voltage V to the operation checking voltage V2 in step 620, and proceeds to step 640 where a check is made to see if the detected current I is equal to or greater than the predetermined threshold Ith. By this, it is seen if the light source 20 is emitting a light of appropriate intensity, the photo-sensor is detecting the light normally. If the result of the check is YES, the CPU informs the console 50 of normal operation of the system 100 to cause the console 50 to indicate the normal operation, e.g., turn on the LED 54 labeled "TONER SYSTEM" or display "Toner system is normal." on the display 58. If the check result in step 640 is NO, then the CPU branches off to step 680, where the CPU informs the console 50 of abnormal operation of the system 100 to cause the console 50 to indicate the abnormal operation, e.g., blink the LED 54 labeled "TONER SYSTEM" or display "Toner system is abnormal." on the display 58. After the CPU completes the step 660 or 680, it proceeds to the toner content monitoring stage or step 700.

In step 700, the CPU 42 sets the light source voltage V to the content monitoring voltage V1, and proceeds to step 720, where the CPU makes a check to see if the detected current I is equal to or greater than the predetermined threshold, that is, if the toner content in ink is becoming insufficient and a toner supply is necessary. If the detected current I is equal to or greater than the predetermined threshold, the CPU sends, in step 740, to the console 50 a signal warning the user to supply toner to cause the console 50 to indicate the need of toner supply, e.g., blink the LED 56 labeled "TONER SUFFICIENT" or display "Supply toner." on the display 58. Otherwise, the CPU sends, in step 760, a signal indicating the sufficiency of toner to the console 50 to cause the console 50 to indicate the sufficiency, e.g., turn on the LED 56 or display "Toner is sufficient." on the display 58. The CPU 42 repeats, by loop 780, the steps following the step 700 while the printer, (not shown) incorporating the toner content monitoring system 100, is operating.

Thus, the user supplying toner according to the indication on the console 50 can keep the toner content in the ink above the predetermined toner content or the supply-requesting content C1 and ensure a sufficient residual quantity of toner to thereby permit high-speed high-quality printing as provided by an electrophotographic printer.

Though the program shown as FIG. 6 has been described as one program, the program may be divided into two subroutines or programs 600*a* and 600*b*. Doing this is especially recommended if the controller is also to be used for the other controls necessary for operation of the printer (not shown). In such a case, the subroutine or a program 600*a* is executed each time of turn-on or reset. The subroutine 600*b* is periodically called during an operation of the printer (not shown).

Modifications

The light source 20 and the photo-sensor 30 may be disposed in ink storage chamber (not shown) walls instead of ink chamber 1 walls.

A plurality of toner monitoring voltages may be set in the range near to and higher than the above described toner monitoring voltage V1. Monitoring toner content with varying voltages will eliminate errors in the detection of the toner content, permitting a more reliable toner content monitoring.

When the light source voltage V is fixed instead of changing it, the toner content may be detected by changing the threshold current Ith of the photo-sensor 30.

The insufficiency of toner or the need for toner supply may be warned by means of a sound instead of blinking the LED 56 or displaying the message to the effect on the display 58.

Embodiment II

In the above description, the content monitoring is directed to the case of opaque charged toner in transparent ink within recording head 10*a*. However, the above described method and system can be applied to any case where transparent liquid contains opaque particles, because the detection of the particle content is achieved by utilizing the opaqueness of the particles. In the case of charged particles, a system and a method according to the present invention may be another technique for detecting the content of charged particles in liquid as will be described in the following.

In a second illustrative embodiment of the invention, the charged toner content in electrically neutral ink is monitored by detecting the electrostatic capacitance of a pair of electrodes disposed in parallel with an ink space between the electrodes. In this case, the liquid may be either transparent or opaque.

Figure 7:
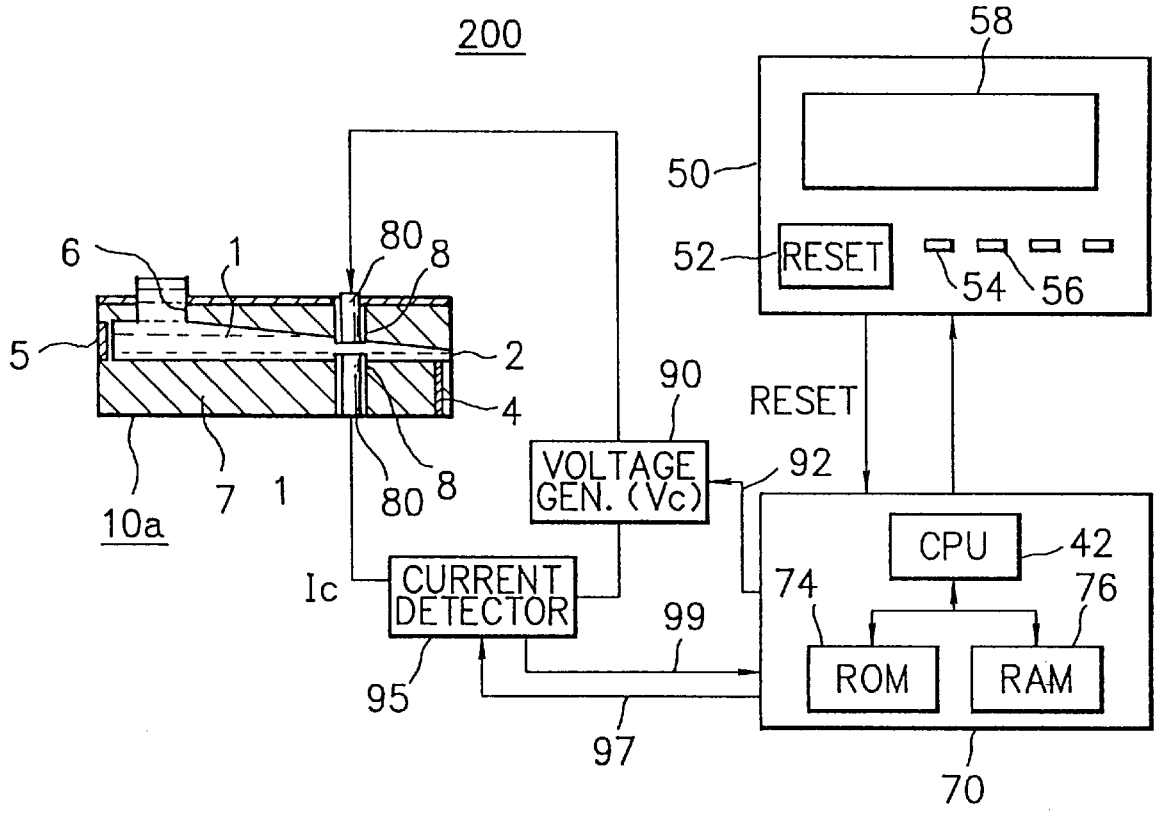
FIG. 7 is a diagram showing a toner content monitoring system according to a second illustrative embodiment of the invention.

FIG. 7 is a diagram showing a toner content monitoring system according to the second illustrative embodiment of the invention. FIG. 7 is identical to FIG. 2 excepting the following points: the LED 20 and the photo-sensor 30 of FIG. 2 have been replaced by a pair of electrodes 80 constituting a capacitor; the electrodes 80 are connected in serial with a voltage generator 90 for generating a content monitoring capacitor voltage Vc and a current detector 95 for detecting a current that runs through the capacitor 80; and the ROM 44 and the RAM 46 of FIG. 2 have been replaced by ROM 74 and RAM 76, and accordingly the controller has been replaced with a controller 70 because the control of the toner monitoring system 100 of FIG. 2 is different from that of the system 200. The other elements in FIG. 7 are identical to those of FIG. 2, and their explanations are omitted.

Specifically, the voltage generator 90 generates, for example, a rectangular pulse of a voltage Vc in response to a control signal 92 from the controller 70. The controller 70 issues the control signals 92, for example, at intervals equivalent to a monitoring period which is set for a value sufficiently longer than a possible time constant of the circuit comprising the capacitor 80 and the voltage generator 90. This permits continuous toner content monitoring during operation of the printer incorporating the toner content monitoring system 200. The current detector 95 compares the detected current Ic with a threshold current Icth for the capacitor 80 and outputs, indicated at 97, 99, a logical HIGH level if Ic≧Icth and a logical LOW level if Ic<Icth.

It is noted that the surface of each electrode 80 that is exposed to the ink is coated with insulator material so that the coated insulator material prevents charged toner from sticking to and accumulating on the surface of the electrodes 80. This contributes to a reduction of errors which may occur in detecting the charging current of the capacitor 80.

Figure 8:
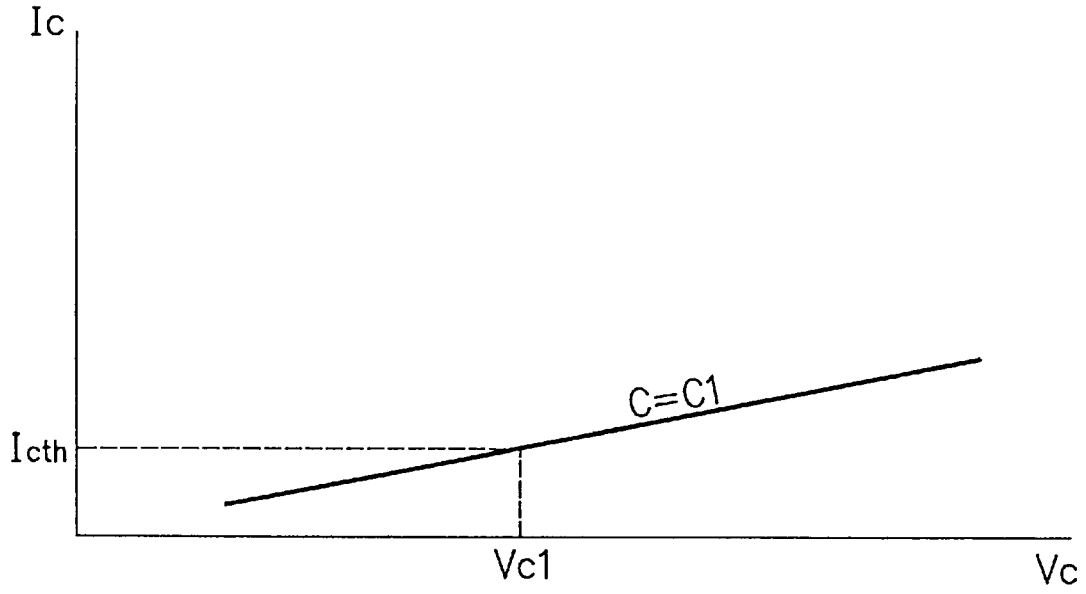
FIG. 8 is a diagram showing a relation between the capacitor voltage Vc and the detected capacitor current Ic when the toner content is the minimum allowable.
Figure 10:
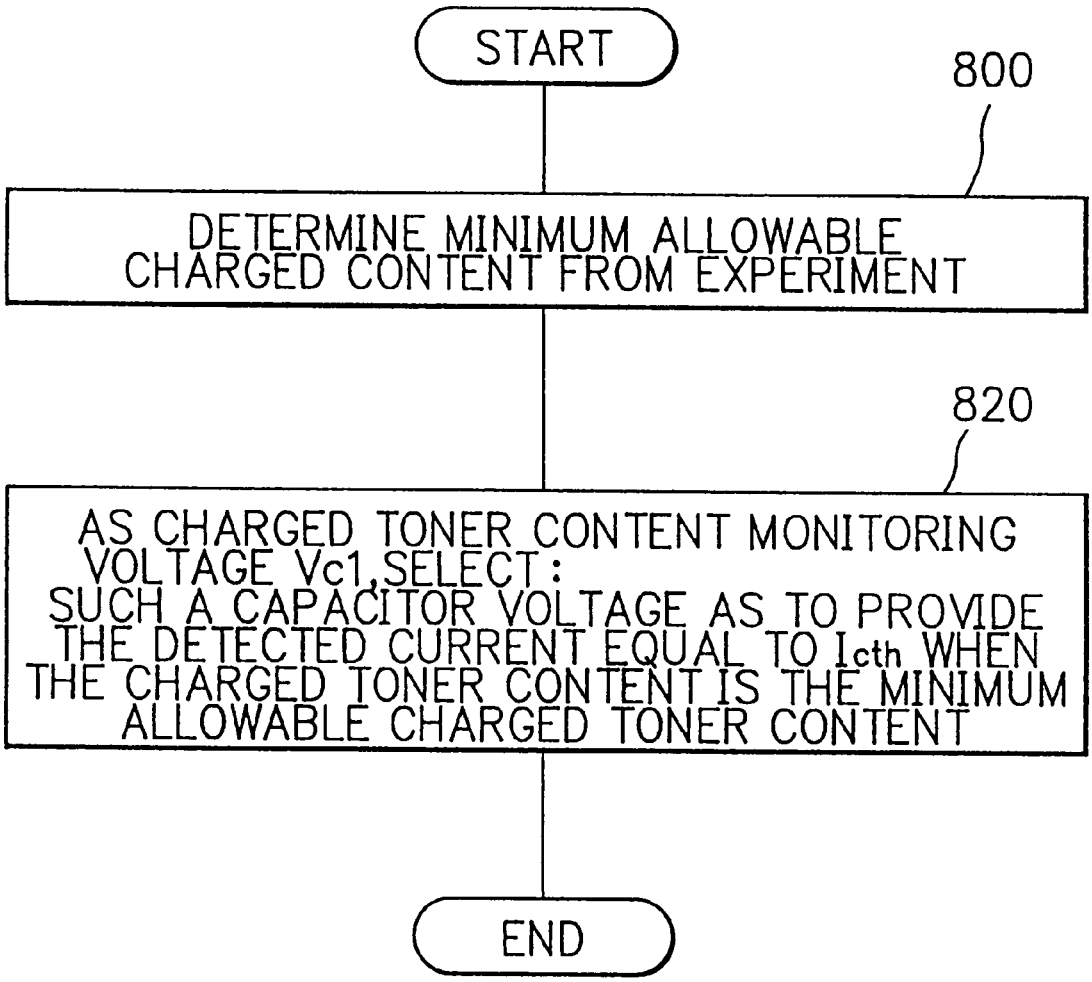
FIG. 10 is a flow chart showing an exemplary flow of procedures for obtaining the toner content monitoring voltage according to the second illustrative embodiment of the invention.

FIG. 8 is a diagram showing a relation between the capacitor voltage Vc and the detected capacitor current Ic when the charged toner content is the minimum allowable. FIG. 10 is a flow chart showing an exemplary flow of procedures for obtaining the toner content monitoring voltage according to the second illustrative embodiment of the invention. In FIG. 10, during manufacture the minimum allowable charged toner content or the supply-requesting content C1 is set from experiments in step 800. Also, from experiments, a capacitor voltage which provides a detected current equal to the threshold current Icth when the charged toner content is the minimum allowable charged toner content C1 is selected as the toner content monitoring voltage Vc1, as shown in FIG. 8 in step 820.

Figure 9:
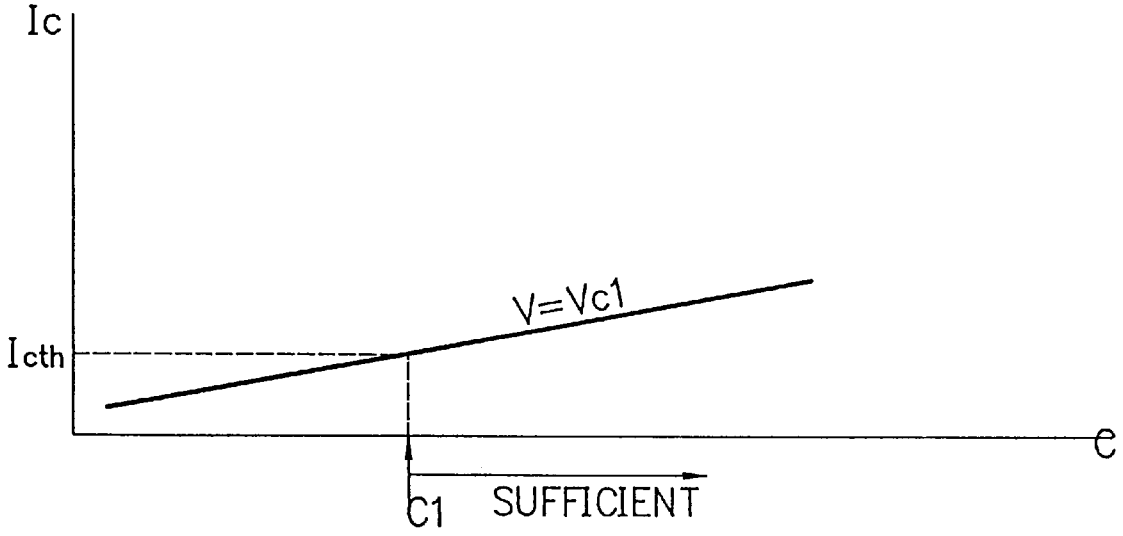
FIG. 9 is a diagram showing a relation between the toner content C and the detected capacitor current Ic when the capacitor voltage is the content monitoring voltage.
Figure 11:
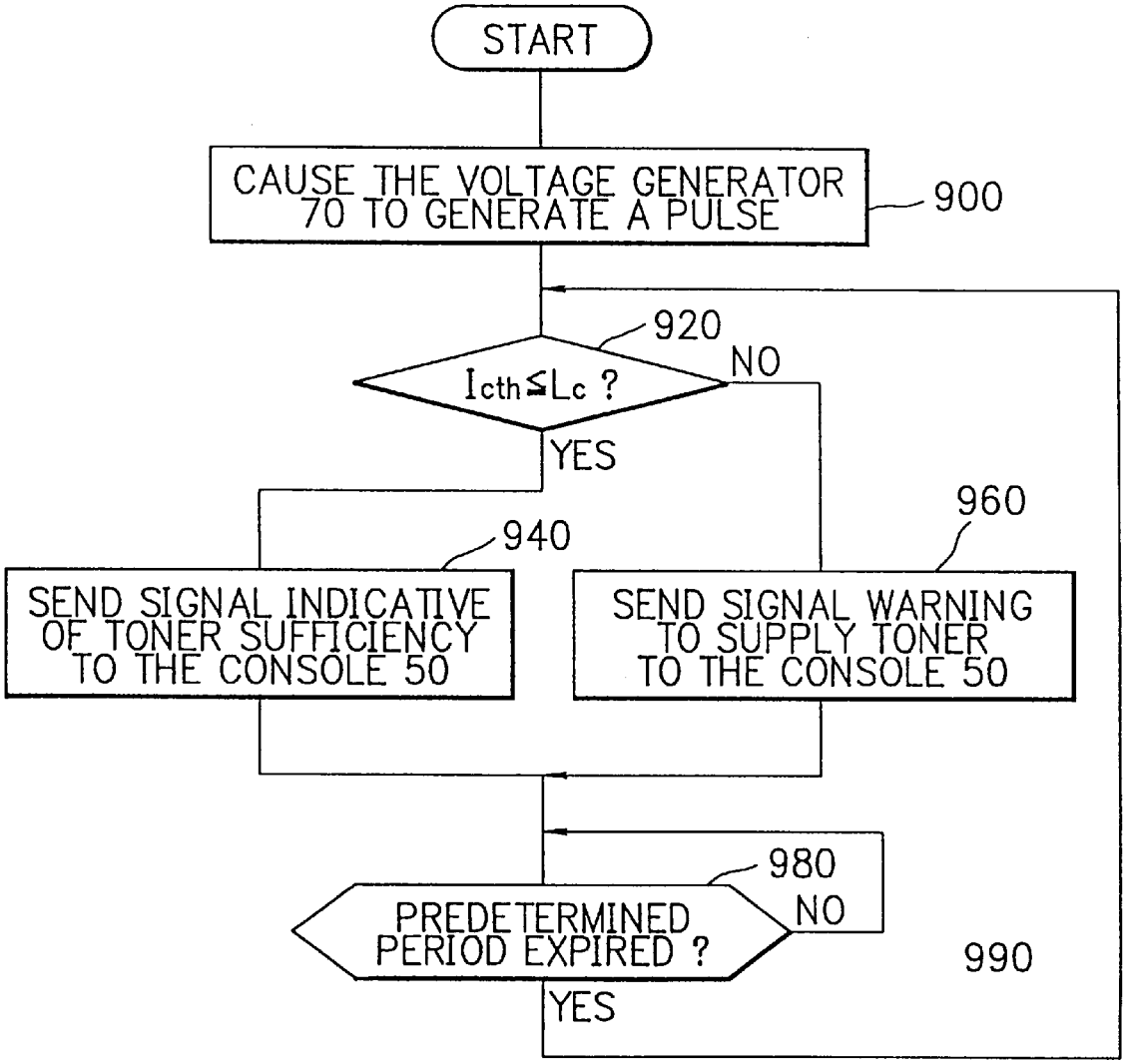
FIG. 11 is a flow chart showing an exemplary program for monitoring the toner content according to the second illustrative embodiment.

FIG. 9 is a diagram showing a relation between the toner content C and the detected capacitor current Ic when the capacitor voltage Vc is the content monitoring voltage Vc1. FIG. 11 is a flow chart showing an exemplary program for monitoring the toner content according to the second illustrative embodiment.

In FIG. 11, the controller 70 cause the voltage generator 90 to generate a rectangulator pulse in step 900. In response to this, if the controller 70 receives a HIGH output signal from the current detector 95, that is, Icth≦Ic, then the controller 70 determines, in step 920, that the charged toner content C is sufficient, and sends a signal indivative of the sufficiency of toner to the console 50 in step 940. With the decrease in the charged toner content, the capacitance of the capacitor 80 decreases, that is, the detected current Ic decreases. If the controller 70 receives a LOW output signal from the current detector 95, that is, Icth>Ic, then the controller 70 determines, in step 920, that the charged toner content C is insufficient, and sends a signal indivative of the insufficiency of toner to the console 50 in step 960. Repeating the just described procedures through loop 990 at predetermined intervals determined in step 980, the predetermined charged toner content C1 is ensured, which permits high-speed high-quality printing.

In the second illustrative embodiment, the current detector 95 supplied the controller 70 with a binary signal indicating whether the detected current Ic is equal to or larger than the threshold Icth. Alternatively, the current detector 95 may supply a signal of a magnitude proportional to the detected current Ic either to the controller 70, which in turn sends to the console 50 a signal (probably a digital signal) indicative of the detected current Ic value, or directly to the console 50. The console 50 may display the detected current in the form of a figure or a bar graph.

Though the present invention has been described with reference to the particular illustrative embodiments, it is not to be restricted by those embodiments but only by the appended claims. It is to be understood that those skilled in the art can change or modify the embodiments without departing from the scope and spirit of the present invention.

What is claim is:

1. A system for determining if the content of opaque toner dispersed in a transparent ink is at least equal to a predetermined content level, the system comprising:

a chamber, formed by a wall, having an ink passage for containing the ink;

a light source and a photo-detector embedded in said wall of said chamber, wherein said photo-detector is positioned to detect light from said light source that passes through said ink passage;

means for supplying said light source with a predetermined content monitoring voltage associated with said predetermined content level and for supplying said light source with an operation check voltage larger than said predetermined content monitoring voltage;

means for determining that said opaque toner content is lower than said predetermined content level if a current obtained from said photo-detector is larger than a predetermined threshold current when said predetermined content monitoring voltage is applied to said light source, and for determining that said opaque toner content is at least equal to said predetermined content level if a current obtained from said photo-detector is not larger than said predetermined threshold current when said predetermined content monitoring voltage is applied to said light source; and means for determining that operation of the system is faultless if the current obtained from said photo-detector, upon application of the operation check voltage to said light source, is larger than said predetermined threshold current, and for determining that operation of the system is defective if the current obtained from said photo-detector, upon application of the operation check voltage to said light source, is not larger than said predetermined threshold current.

2. A system as defined in claim 1, wherein:

said content monitoring voltage is of such a value that an application of said content monitoring voltage to said light source causes said photo-detector to yield a current equal to said predetermined threshold current level when said opaque toner content equals said predetermined content level.

3. A system as defined in claim 1, wherein said determining means further comprises means for repeating said determining during operation of the system.

4. A system as defined in claim 1, further comprising:

means, responsive to any of a turning-on and a reset of the system, for activating said means for determining that operation of the system is faultless.

5. A system as defined in claim 1, wherein:

said operation check voltage is of such a value that an application of just said operation check voltage to said light source will cause said photo-detector to yield a current equal to said predetermined threshold current level when said opaque toner content is sufficiently larger than said predetermined content level.

6. A system as defined in claim 1, further comprising:

a console having means for permitting a user to operate the system and means for displaying information about the system; and means for sending a signal from each of said determining means to said console to cause said console to display information.

7. A system as defined in claim 1, wherein said chamber is an ink chamber in a recording head.

8. The system as defined in claim 7, wherein said recording head is located in an electrostatic ink-jet printer.

9. A method for establishing a quantity of light necessary for determining if the content of opaque particles dispersed in a transparent solvent in a chamber, defined by a housing, is at least equal to a predetermined content level, wherein a light source and a photo-detector are embedded in said housing such that said photo-detector detects light from said light source that passes through said solvent, the method comprising the steps of:

supplying a transparent solvent, having opaque particles equal to a predetermined minimum content level, to said chamber;

supplying said light source with a voltage;

monitoring the detected electric current from the photo-detector, while gradually increasing the voltage applied to the light source until the detected current reaches a predetermined threshold level, and selecting the last applied voltage as a content monitoring voltage.

10. A method as defined in claim 9, further comprising:

supplying a transparent solvent, having opaque particles equal to a predetermined maximum content level, to said chamber;

supplying said light source with voltage;

monitoring the detected electric current from the photo-detector, while gradually increasing the voltage applied to the light source until the detected current reaches said predetermined threshold level, and selecting the last applied voltage as an operation check voltage.

11. A system for determining if the content of opaque toner dispersed in a transparent ink is at least equal to a predetermined content level, the system comprising:

a chamber, formed by a wall, having an ink passage for containing the ink;

a light source and a photo-detector embedded in said wall of said chamber, wherein said photo-detector is positioned to detect light from said light source that passes through said ink passage;

means for causing said light source to emit a predetermined content monitoring quantity of light associated with said predetermined content level, and for causing said light source to emit an operation check quantity of light larger than said predetermined content monitoring quantity of light;

means for determining that said opaque toner content is lower than said predetermined content level if a quantity of light detected by said photo-detector is larger than a predetermined threshold quantity of light when said predetermined content monitoring quantity of light is emitted by said light source, and for determining that said opaque toner content is at least equal to said predetermined content level if a quantity of light detected by said photo-detector is not larger than said predetermined threshold quantity of light when said predetermined content monitoring quantity of light is emitted by said light source; and means for determining that operation of the system is faultless if the quantity of light detected by said photo-detector, upon emission of the operation check quantity of light from said light source, is larger than said predetermined threshold quantity of light, and for determining that operation of the system is defective if the quantity of light detected by said photo-detector, upon emission of the operation check quantity of light by said light source, is not larger than said predetermined threshold quantity of light.

* * * * *

UNITED STATES PATENT AND TRADEMARK OFFICE

CERTIFICATE OF CORRECTION

PATENT NO. : 5,905,510

DATED : May 18, 1999

INVENTOR(S) : Yoshihiro Hagiwara, Hitoshi Minemoto, Ryosuke Uematsu, Junichi Suetsugu, and Kazuo Shima It is certified that error appears in the above-indentified patent and that said Letters Patent is hereby corrected as shown below:

Column 4, line 12, delete "58" and insert --50-- and delete "50" and insert --58--.

Column 8, line 8, after "or" insert --may supply a signal--.

Signed and Sealed this

Thirteenth Day of March, 2001

*Attest:*

*Attesting Officer*

NICHOLAS P. GODICI

*Acting Director of the United States Patent and Trademark Office*